US009953503B2

(12) United States Patent
Smith

(10) Patent No.: US 9,953,503 B2
(45) Date of Patent: Apr. 24, 2018

(54) DOOR AND WINDOW CONTACT SYSTEMS AND METHODS THAT INCLUDE MEMS ACCELEROMETERS AND MEMS MAGNETOMETERS

(71) Applicant: Honeywell International Inc., Morristown, NJ (US)

(72) Inventor: Richard Alan Smith, Sunriver, OR (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 1 day.

(21) Appl. No.: 15/050,855

(22) Filed: Feb. 23, 2016

(65) Prior Publication Data

US 2017/0243456 A1 Aug. 24, 2017

(51) Int. Cl.

| | |
|---|---|
| ***G08B 13/08*** | (2006.01) |
| ***G08B 13/24*** | (2006.01) |
| ***G08B 13/02*** | (2006.01) |

(52) U.S. Cl.

CPC ..... *G08B 13/2494* (2013.01); *G08B 13/02* (2013.01); *G08B 13/08* (2013.01)

(58) Field of Classification Search

None

See application file for complete search history.

(56) References Cited

U.S. PATENT DOCUMENTS

| | | | |
|---|---|---|---|
| 3,745,553 | A | 7/1973 | Kardashian |
| 4,359,646 | A | 11/1982 | Mejia et al. |
| 6,301,549 | B1 | 10/2001 | Barney |
| 6,310,549 | B1 | 10/2001 | Loftin et al. |

(Continued)

FOREIGN PATENT DOCUMENTS

| | | | |
|---|---|---|---|
| DE | 10 2013 220 176 | A1 | 4/2015 |
| WO | 2014/154738 | A1 | 10/2014 |
| WO | 2015/017805 | A1 | 2/2015 |

OTHER PUBLICATIONS

Extended European search report for corresponding EP patent application 17153416.7, dated Jul. 17, 2017.

(Continued)

*Primary Examiner* — George Bugg
*Assistant Examiner* — Renee Dorsey
(74) *Attorney, Agent, or Firm* — Husch Blackwell LLP

(57) ABSTRACT

Systems and methods that address the gap, security, and robustness limitations of known door and window contact systems and methods without increasing the overall cost thereof are provided. Some systems can include an accelerometer and a magnetometer for mounting in or on a first portion of a window or door unit and a microcontroller unit in communication with each of the accelerometer and the magnetometer. The accelerometer can measure acceleration or vibration relative to a second portion of the window or door unit and transmit the measured acceleration or vibration to the microcontroller unit, the magnetometer can measure magnetic field relative to a sensor magnet mounted on or embedded in the second portion of the window or door unit and transmit the measured magnetic field to the microcontroller unit, and the microcontroller unit can use the measured acceleration or vibration and the measured magnetic field to make a security determination.

12 Claims, 1 Drawing Sheet

(56) References Cited

U.S. PATENT DOCUMENTS

| | | | | |
|---|---|---|---|---|
| 6,472,993 | B1 | 10/2002 | Addy | |
| 6,724,316 | B2 | 4/2004 | Addy et al. | |
| 6,850,252 | B1 * | 2/2005 | Hoffberg | G06K 9/00369 348/E7.061 |
| 6,882,275 | B2 | 4/2005 | Blanpain et al. | |
| 8,970,373 | B2 | 3/2015 | Buckley et al. | |
| 9,245,432 | B2 | 1/2016 | Yang | |
| 2015/0330140 | A1 | 11/2015 | Kincaid et al. | |
| 2015/0348385 | A1 * | 12/2015 | Lamb | G08B 29/20 340/547 |
| 2016/0187118 | A1 * | 6/2016 | Modi | G01B 7/14 340/815.45 |
| 2016/0187368 | A1 * | 6/2016 | Modi | G08B 13/08 702/141 |
| 2016/0189506 | A1 * | 6/2016 | Peterson | G08B 13/24 340/551 |
| 2016/0189527 | A1 * | 6/2016 | Peterson | G08B 25/008 340/541 |

OTHER PUBLICATIONS

English-language translation of Abstract for for DE patent application publication 10 2013 220 176, dated Apr. 23, 2015.

* cited by examiner

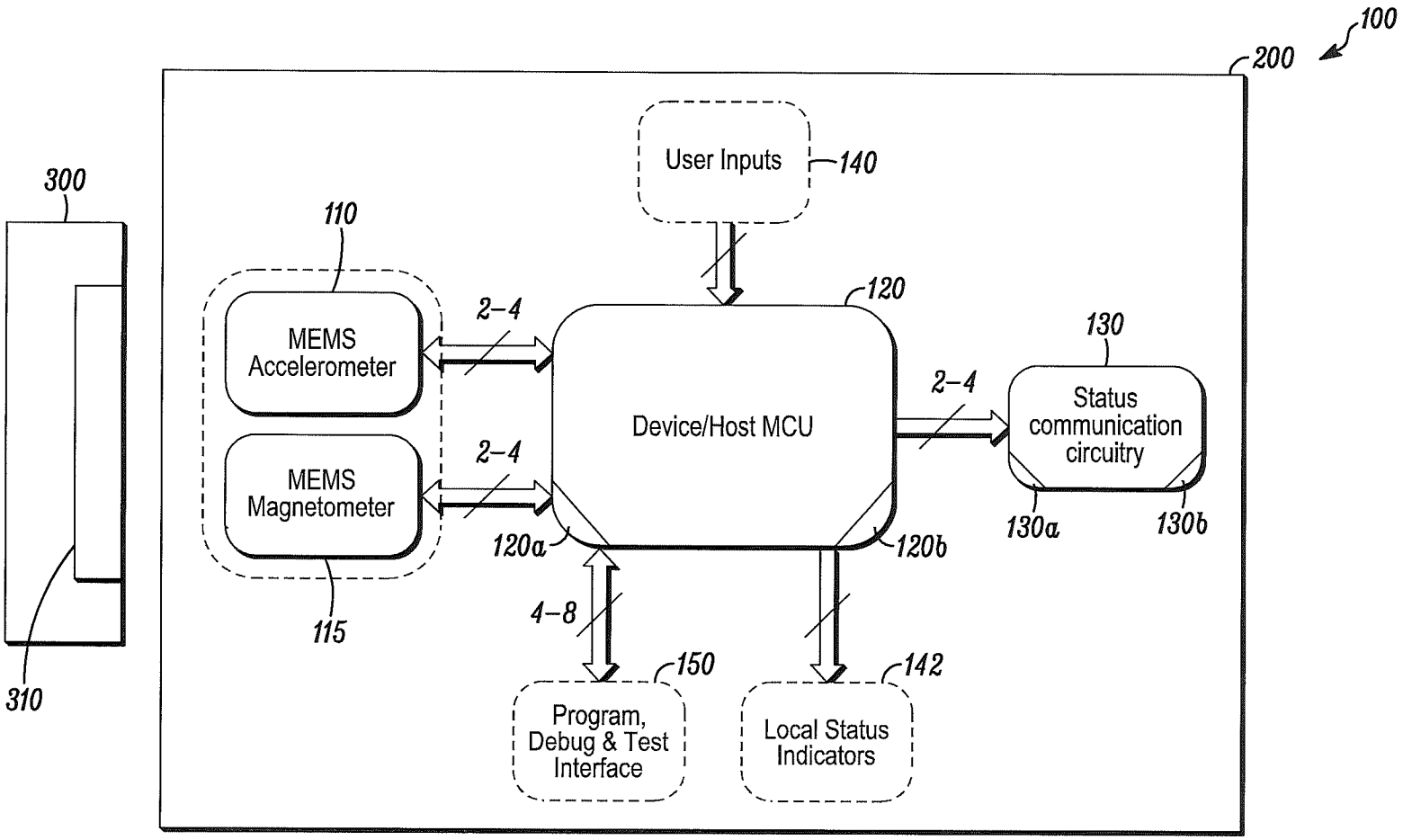
100
200
User Inputs
140
Device/Host MCU
120
120a
120b
Status communication circuitry
130
130a
130b
2–4
Local Status Indicators
142
Program, Debug & Test Interface
150
4–8
MEMS Accelerometer
110
MEMS Magnetometer
115
2–4
2–4
300
310

DOOR AND WINDOW CONTACT SYSTEMS AND METHODS THAT INCLUDE MEMS ACCELEROMETERS AND MEMS MAGNETOMETERS

FIELD

The present invention relates generally to door and window contact systems and methods. More particularly, the present invention relates to door and window contact systems and methods that include MEMS accelerometers and MEMS magnetometers.

BACKGROUND

Known intrusion detection systems can include door and window contact systems and methods that are based on reed and magnet technology. While inexpensive to implement, reed and magnet technology presents at least three significant limitations.

First, in reed and magnet technology, there are limitations on a distance of a gap between electrical contacts of a reed switch. "Wide-gap" reed switches have had their maximum functional gap stretched to reliable limits through various methods. However, mounting the electrical contacts of the reed switch on surfaces constructed of ferrous metal materials can result in a magnetic field flux interference that reduces a maximum operating gap. To maximize an effective gap, an expensive magnet is required, which is undesirable.

Second, reed and magnet technology is vulnerable to attempts to defeat (AtD) a system by an intruder. For example, the electrical contacts in the reed switch can be defeated by the intruder introducing a magnet in close proximity to the switch. Some systems and methods are known to reduce such security vulnerability, but all incur additional cost, which is undesirable.

Furthermore, in some situations, a user may wish to arm the system while a window(s) is in a partially opened position. However, such a position will likely exceed the maximum functional gap of the electrical contacts of the reed switch. Accordingly, a "bypass" mode can be invoked, but the "bypass" mode can further compromise perimeter intrusion detection, thereby making attempts to defeat by the intruder more likely to be successful.

Finally, when reed and magnet technology is employed, a magnet must be installed in the system. Such an installation further adds to overall cost.

In view of the above, there is a continuing, ongoing need for a system and method to address the gap, security, and robustness limitations of known door and window contact systems and methods without increasing the overall cost thereof.

BRIEF DESCRIPTION OF THE DRAWINGS

FIG. 1 is a block diagram of a system in accordance with disclosed embodiments.

DETAILED DESCRIPTION

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include systems and methods that address the gap, security, and robustness limitations of known door and window contact systems and methods without increasing the overall cost thereof. For example, door and window contact systems and methods disclosed herein can include MEMS accelerometers and MEMS magnetometers. In some embodiments, a MEMS accelerometer and a MEMS magnetometer can be housed or included in the same device, such as a sensor integrated circuit (IC).

In some embodiments, each of the accelerometer and the magnetometer disclosed herein can include a single axis version or a 3-axis version. However, when the 3-axis version is included, the intelligence of systems and methods disclosed herein can be increased as compared to when the single axis version is included.

In some embodiments, systems and methods disclosed herein can include a microcontroller unit or microprocessor that can execute intelligent signal analysis algorithms for detecting relative door or window movement, partial and complete closure events, and/or attempts to defeat. For example, in some embodiments, the microcontroller unit can execute a plurality of different signal analysis algorithms and can determine which one of the plurality of algorithms to execute based on received user input or based on detected events. Indeed, in some embodiments, the user input can specify whether a monitored window or door is to be monitored in an open, closed or partially open position, and the microcontroller unit can execute the appropriate signal analysis algorithm based on such input. Furthermore, in some embodiments, the microcontroller unit can execute an attempt to defeat analysis algorithm responsive to detecting a non-sensor magnet introduced into an ambient environment. In these embodiments, the microcontroller unit can determine whether any detected movement is a valid movement or an attempt to defeat event.

It is to be understood that, by combining accelerometer output with magnetometer output, systems and methods disclosed herein can detect and confirm a plurality events, including, but not limited to the following physical events related to doors, windows, or other moving objects: (1) relative movement, for example, defining a starting position (0,0) that is open or closed and armed or disarmed; (2) partial and complete closure, including previously detected open positions that resulted in a fault detection; (3) attempts to defeat, for example, when a magnetic field is introduced; (4) movement direction, for example, opening vs. closing, moving towards home, closed, or away from home or closed, previously detected open positions, and boundary limits identified during installation; and (5) sensor orientation, for example, at rest.

In accordance with disclosed embodiments, movement with a predetermined acceleration or vibration can be initially detected by analyzing the magnitude of acceleration or vibration on all axes or vectors of the accelerometer disclosed herein to determine whether movement has occurred. When such an analysis is indicative of movement, the magnitude of magnetic flux on all axes or vectors of the magnetometer disclosed herein can be analyzed to validate or confirm the detected movement. In some embodiments, the magnitude of acceleration or vibration on the axes or vectors of the accelerometer and/or the magnitude of magnetic flux on the axes or vectors of the magnetometer can be compared to predetermined reference values or expected values, and systems and methods disclosed herein can determine whether the results of such a comparison are indicative of the detected movement.

Additionally or alternatively, the magnitude of magnetic flux on the axes or vectors of the magnetometer can be periodically sampled and analyzed to determine whether a change in magnetic flux magnitude has occurred, to compare any new magnetic flux magnitude to the predetermined reference values or expected values, and to determine whether the results of such a comparison are indicative of movement. When the comparison results are indicative of movement, the magnitude of acceleration or vibration detected on the axes or vectors of the accelerometer can be detected to validate or confirm the identified movement. In some embodiments, the magnitude of acceleration or vibration on the axes or vectors of the accelerometer can be compared to the predetermined reference values or expected values, and systems and methods disclosed herein can determine whether the result of such a comparison are indicative of the identified movement.

In accordance with disclosed embodiments, when an attempt to defeat magnet is outside of a predetermined range of a sensor circuit, the amount of influence of the attempt to defeat magnet on magnetic fields is dependent on the proximity of a sensor magnet to the sensor circuit. However, because movement of the sensor magnet can result in a magnetic field strength change detected by the sensor circuit, the attempt to defeat condition can be detected by systems and methods disclosed herein. When the attempt to defeat magnet is placed within the predetermined range of the sensor circuit, the magnitude of magnetic field on all axes of the sensor circuit can be low, which can cause the movement of the sensor magnet to be undetectable. However, when the sensor circuit moves with respect to both the sensor magnet and the attempt to defeat magnet, a change in the magnitude of the magnetic field can be detected. In any embodiment, when the attempt to defeat magnet is placed within close proximity of the sensor magnet, the attempt to defeat magnet can have minimal effect until the sensor magnet moves.

In accordance with disclosed embodiments, when the 3-axis version of the magnetometer is included in the sensor circuit and the magnitude of magnetic flux of at least two axes is below one of the predetermined reference values or expected values, systems and methods disclosed herein can determine that the non-sensor magnet is likely near the sensor circuit and that the attempt to defeat event may be occurring. Indeed, the magnetometer may be saturated by the non-sensor magnet. Similarly, when the single axis version of the magnetometer is included in the sensor circuit and the magnitude of magnetic flux of the single axis is above the one of the predetermined reference values or expected values, systems and methods disclosed herein can determine that the non-sensor magnet is likely near the sensor circuit and that the attempt to defeat event may be occurring. In accordance with the above, the magnitude of acceleration or vibration detected on the axes or vectors of the accelerometer can be used to confirm any attempt to defeat event identified by the output of the magnetometer.

In some embodiments, each of the accelerometer and magnetometer can be sampled periodically and at predetermined intervals to optimize performance and power consumption. This is especially advantageous in battery powered embodiments.

It is to be understood that the predetermined reference values and expected values discussed above and herein can be predetermined while taking into account one or more of the following considerations: (1) geomagnetic field strength variation, (2) relative geolocation, (3) changes over time, and (4) field disturbances. For example, in some embodiments, the sensor circuit described above and herein and the sensor magnet can be installed as described herein. During installation, spatial and flux line relationships of the sensor magnet and the sensor circuit and magnetic field strength in open and closed positions can be learned by systems and methods disclosed herein, and responsive thereto, the predetermined reference values and expected values can be identified. In some embodiments, such an installation mode can be entered when power is initially applied to the sensor circuit, and in some embodiments, the installation mode can span a predetermined period of time.

In accordance with the above and other embodiments disclosed herein, movement of a hinged window or door can be detected by sensing a change in the orientation of the window or door relative to the earth's poles and the predetermined reference values and expected values. However, movement vectors of a sliding window or door in a horizontal or vertical linear direction have a very low orientation change relative to the earth's poles. Accordingly, the change in magnetic field strength along the linear slide vector may be too low to detect within reasonable slide distances, except in cases where a mounting surface for the sensor circuit includes a door or window frame material that is made of a ferrous metal, which can have a significant effect on magnetic field strength and result in a distortion of magnetic flux lines that are discernible and change with movement. Systems and methods disclosed herein can overcome these obstacles to accurately and effectively detect the movement of the sliding door or window even when the mounting surface includes a non-ferrous metal.

The accelerometer or magnetometer in accordance with disclosed embodiments can be placed in one of a plurality of different locations. For example, in some embodiments, a sensing circuit chip that includes the accelerometer or magnetometer can be mounted in a window or door recess, for example, in a recessed channel of a window frame or in a recessed channel of a door frame on the side thereof supporting the hinge of a swinging door. In these embodiments, the sensing circuit chip can sense the movement and magnetic field relative to a moving portion of a window or door. Additionally or alternatively, in some embodiments, the sensing circuit chip that includes the accelerometer or magnetometer can be mounted on a surface of the door or window, for example, on the moving part thereof, including on a window or a roll-up door. In these embodiments, the sensing circuit chip can sense the movement and magnetic field relative to a non-moving portion, for example, the window or door frame.

FIG. 1 is a block diagram of a system 100 in accordance with disclosed embodiments. In some embodiments, the system 100 can be embodied in or on a chip and/or in a housing 200.

As seen in FIG. 1, the system 100 can include a MEMS accelerometer 110, a MEMS magnetometer 115, a microcontroller unit 120, communication circuitry 130, and a user interface that can include user input mechanisms 140 and user output mechanisms 142, for example, status indicators. In some embodiments, the system 100 can also include an interface 150 for programming, debugging, and testing the microcontroller unit 120.

As seen in FIG. 1, the microcontroller unit 120 can be in communication with each of the accelerometer 110, the magnetometer 115, the communication circuitry 130, the user input mechanisms 140, the user output mechanisms 142, and the interface 150. It is to be understood that some or all of this communication be wired and/or wireless as would be understood by one of ordinary skill in the art.

In some embodiments, the accelerometer 110 can transmit a signal to the microcontroller unit 120 indicative of the magnitude of measured acceleration or vibration on all axes or vectors of the accelerometers 110 and relative to a surface 300. Similarly, in some embodiments, the magnetometer 115 can transmit a signal to the microcontroller unit 120 indicative of the magnitude of measured magnetic flux on all axes or vectors of the magnetometer 115 and relative to a sensor magnet 310 that can be mounted on or embedded in the surface 300.

In accordance with the above, in some embodiments, the housing 200 and/or the sensor 110 can be mounted in or on a non-moving portion of a window or door, for example, a window or door frame, and the surface 300 can include a moving portion of the window or door, for example, the window or door itself. Additionally or alternatively, in some embodiments, the housing 200 and/or the sensor 100 can be mounted in or on the moving portion of the window or door, for example, the window or door itself, and the surface 300 can include the non-moving portion of the window or door, for example, the window or door frame.

The accelerometer 110 and the magnetometer 115 can transmit signals to the microcontroller unit 120 as described above, and the microcontroller unit 120 can use the received signals to make a security determination in accordance with disclosed embodiments. For example, in some embodiments, the microcontroller unit 120 can use the received signals to identify door or window movement, partial and complete closure events, or attempts to defeat.

In some embodiments, a user can provide user input to the microcontroller unit 120 via the user input mechanisms 140. For example, in some embodiments, the user input can specify the allowed range of movement for the relevant window or door and/or specify whether the relevant window or door is to be monitored in a closed, open, or partially opened or closed position or state. The microcontroller unit 120 can use the received user input when making the security determination as described above. Additionally or alternatively, the microcontroller unit 120 can use the received user input to determine an appropriate algorithm to execute when analyzing the received signals to make the security determination as described above.

Based on the results of the security determination, in some embodiments, the microcontroller unit 120 can provide an indication thereof to a user via the user output mechanisms 142. Additionally or alternatively, in some embodiments, the microcontroller unit 120 can transmit the indication of the results of the security determination to a remote or local security system via the communication circuitry 130.

It is be understood that the microcontroller unit 120 and/or the communication circuitry 130 can include one or more programmable processors 120*a*, 130*a* and executable control software 120*b*, 130*b* as would be understood by one of ordinary skill in the art. The executable control software 120*b*, 130*b* can be stored on a transitory or non-transitory computer readable medium, including, but not limited to local computer memory, RAM, optical storage media, magnetic storage media, flash memory, and the like. In some embodiments, the executable control software can include the signal analysis algorithms as described above and/or can make the security determination as described above.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A system comprising:

an accelerometer;

a magnetometer; and a microcontroller unit in communication with each of the accelerometer and the magnetometer;

a housing containing the accelerometer, the magnetometer, and the microcontroller unit; and a sensor magnet coupled to a surface in a displaced relationship with the housing, wherein the accelerometer measures a current acceleration or vibration value for the housing relative to the surface and transmits the current acceleration or vibration value to the microcontroller unit, wherein the magnetometer measures a current magnetic field value relative to the sensor magnet and transmits the current magnetic field value to the microcontroller unit, wherein the microcontroller unit includes an installation mode, wherein the microcontroller unit learns a first boundary magnetic field value and a first boundary acceleration or vibration value corresponding to a state of the displaced relationship being open from a combination of a first movement of the housing or the surface and a first user input when the microcontroller unit is in the installation mode, wherein the microcontroller unit learns a second boundary magnetic field value and a second boundary acceleration or vibration value corresponding to the state of the displaced relationship being closed from a combination of a second movement of the housing or the surface and a second user input when the microcontroller unit is in the installation mode, and wherein the microcontroller unit uses the current acceleration or vibration value, the current magnetic field value, the first boundary magnetic field value, the first boundary acceleration or vibration value, the second boundary magnetic field value, and the second boundary acceleration or vibration value to make a security determination.

2. The system of claim 1 wherein the housing moves relative to the surface.

3. The system of claim 1 wherein the surface moves relative to the housing.

4. The system of claim 1 wherein the security determination includes the microcontroller unit determining whether the state of the displaced relationship is open, closed, or partially open or closed or the microcontroller unit identifying an attempt to defeat event.

5. The system of claim 4 wherein the microcontroller unit compares at least one of the current acceleration or vibration value and the current magnetic field value to at least one of the first boundary magnetic field value, the first boundary acceleration or vibration value, the second boundary magnetic field value, or the second boundary acceleration or vibration value to determine whether the state of the displaced relationship is open, closed, or partially open or closed or whether the attempt to defeat event is occurring.

6. The system of claim 1 further comprising:

a user input mechanism in communication with the microcontroller unit, wherein the user input mechanism receives the first user input, the second user input, and a third user input, wherein the user input mechanism transmits the first user input, the second user input, and the third user input to the microcontroller unit, and wherein the microcontroller unit uses the third user input to make the security determination.

7. The system of claim 6 wherein the microcontroller unit identifies a signal analysis algorithm to execute in making the security determination based on the third user input.

8. A method comprising:

coupling a sensor magnet to a surface;

mounting a housing containing an accelerometer, a magnetometer, and a microcontroller unit in a displaced relationship with the surface;

the microcontroller unit learning a first boundary magnetic field value and a first boundary acceleration or vibration value corresponding to a state of the displaced relationship being open from a combination of a first movement of the housing or the surface and a first user input when the microcontroller unit is in an installation mode;

the microcontroller unit learning a second boundary magnetic field value and a second boundary acceleration or vibration value corresponding to the state of the displaced relationship being closed from a combination of a second movement of the housing or the surface and a second user input when the microcontroller unit is in the installation mode;

the accelerometer measuring a current acceleration or vibration value for the housing relative to the surface and transmitting the current acceleration or vibration value to the microcontroller unit;

the magnetometer measuring a current magnetic field value relative to the sensor magnet and transmitting the current magnetic field value to the microcontroller unit; and the microcontroller unit making a security determination using the current acceleration or vibration value, the current magnetic field value, the first boundary magnetic field value, the first boundary acceleration or vibration value, the second boundary magnetic field value, and the second boundary acceleration or vibration value.

9. The method of claim 8 wherein making the security determination includes the microcontroller unit determining whether the state of the displaced relationship is open, closed, or partially open or closed or the microcontroller unit identifying an attempt to defeat event.

10. The method of claim 9 further comprising the microcontroller unit comparing at least one of the current acceleration or vibration value and the current magnetic field value to at least one of the first boundary magnetic field value, the first boundary acceleration or vibration value, the second boundary magnetic field value, or the second boundary acceleration or vibration value to determine whether the state of the displaced relationship is open, closed, or partially open or closed or whether the attempt to defeat event is occurring.

11. The method of claim 8 further comprising:

a user input mechanism receiving the first user input, the second user input, and a third user input;

the user input mechanism transmitting the first user input, the second user input, and the third user input to the microcontroller unit; and the microcontroller unit using the third user input to make the security determination.

12. The method of claim 11 further comprising the microcontroller unit identifying a signal analysis algorithm to execute in making the security determination based on the third user input.

* * * * *